US009982597B2

(12) United States Patent
Poniz

(10) Patent No.: US 9,982,597 B2
(45) Date of Patent: May 29, 2018

(54) COMPACT NON-VIBRATING ENDOTHERMIC ENGINE

(71) Applicant: Pierfrancesco Poniz, Mestre (IT)

(72) Inventor: Pierfrancesco Poniz, Mestre (IT)

( * ) Notice: Subject to any disclaimer, the term of this patent is extended or adjusted under 35 U.S.C. 154(b) by 92 days.

(21) Appl. No.: 14/785,842

(22) PCT Filed: Mar. 17, 2014

(86) PCT No.: PCT/IB2014/059895

§ 371 (c)(1),
(2) Date: Oct. 20, 2015

(87) PCT Pub. No.: WO2014/174383

PCT Pub. Date: Oct. 30, 2014

(65) Prior Publication Data

US 2016/0076441 A1 Mar. 17, 2016

(30) Foreign Application Priority Data

Apr. 22, 2013 (IT) ..... VE2013A0020

(51) Int. Cl.

| | |
|---|---|
| ***F02B 75/28*** | (2006.01) |
| ***F01B 3/04*** | (2006.01) |
| *F02B 75/02* | (2006.01) |

(52) U.S. Cl.

CPC ..... *F02B 75/28* (2013.01); *F01B 3/045* (2013.01); *F02B 75/02* (2013.01); *F02B 2075/025* (2013.01)

(58) Field of Classification Search

CPC ..... F02B 75/28; F02B 75/282; F02B 25/08; F02B 41/04; F02B 75/287

See application file for complete search history.

(56) References Cited

U.S. PATENT DOCUMENTS

| | | | | |
|---|---|---|---|---|
| 2,156,304 | A * | 5/1939 | Phillips | F01B 7/20 123/50 R |
| 3,986,436 | A * | 10/1976 | Kaufman | F01B 3/0005 91/502 |
| 7,124,716 | B2 * | 10/2006 | Novotny | F01B 3/0005 123/56.9 |
| 7,793,623 | B2 * | 9/2010 | Bahnev | F02B 75/26 123/197.1 |
| 8,286,596 | B2 * | 10/2012 | Lemke | F02B 75/28 123/41.35 |

(Continued)

*Primary Examiner* — Long T Tran

(74) *Attorney, Agent, or Firm* — R. Ruschena Patent Agent, LLC

(57) ABSTRACT

The novel, Compact and Non Vibrating Endothermic Engine (CoNVEE) is an internal combustion engine with reciprocating motion of the pistons inside one cylinder. The "CoNVEE" has the mechanism for the transformation of the axial reciprocating motion of the pistons into rotational motion of the motor shaft.

Its innovative architecture makes the engine more compact, given the same delivered power, with respect to the current state of the art. The CoNVEE core occupies a very reduced volume, with a very limited number of moving parts which act in perfect anti-symmetry, compensating all inertia forces developed. The CoNVEE may be conveniently used with any type of propulsion fuel and, particularly, for those applications which require high power density and low vibration in the motor.

9 Claims, 3 Drawing Sheets

(56) References Cited

U.S. PATENT DOCUMENTS

| | | | | |
|---|---|---|---|---|
| 2008/0105224 | A1* | 5/2008 | Kubes | F01B 3/0005 123/56.1 |
| 2008/0283002 | A1* | 11/2008 | Mantheakis | F02B 75/222 123/54.2 |
| 2008/0289606 | A1* | 11/2008 | Bahnev | F01B 3/04 123/45 A |
| 2011/0011368 | A1* | 1/2011 | Raether | F01B 3/0079 123/197.4 |
| 2011/0239642 | A1* | 10/2011 | Schwiesow | F02B 25/08 60/595 |

* cited by examiner

COMPACT NON-VIBRATING ENDOTHERMIC ENGINE

RELATED APPLICATIONS

This application is the U.S. National Stage under 35 USC 371 of PCT Application PCT/IB2014/059895. and claims foreign priority based of Italian patent application VE2013A000020.

BACKGROUND OF THE INVENTION

Field of the Invention

The "Compact Non-vibrating Endothermic Engine" (in the following "CoNVEE") is an internal combustion engine with reciprocating motion of two pistons inside one cylinder; said "CoNVEE" is a two-stroke engine with unidirectional scavenging of the combustion chamber.

SUMMARY OF THE INVENTION

The Compact Non Vibrating Endothermic Engine (CoNVEE in the following) is an internal combustion engine with reciprocating motion of the pistons, whose innovative architecture makes it more compact, given the same delivered power, with respect to the current state of the art. This happens both because the CoNVEE core occupies a very reduced volume, and also because it does not require the presence of any additional compensation or damping of mechanical vibrations. In fact all the moving parts of the CoNVEE are already internally compensated: they act in perfect anti-symmetry compensating each inertia force developed, excluding, of course, that of the motor shaft which is indispensable for the generation of the useful mechanical energy. The intrinsic compactness of the CoNVEE is made possible by the new and characteristic mechanism adopted for the motion transfer from the pistons to the motor shaft. The CoNVEE may be conveniently used with any type of propulsion fuel and, particularly, for those applications which require high power density and low vibration in the motor.

A fundamental innovation that characterizes said "CoNVEE" is the mechanism for the transformation of the axial reciprocating motion of the pistons into rotational motion of the motor shaft. Said mechanism comprises the following three basic parts.

1. A piece here named "T-rod" connected to each piston: said "T-rod" comprises a cylindrical stem which is rigidly attached to the center of the piston 1 at one end, and two equal arms which are rigidly attached on the other end of said cylindrical stem; said two equal arms fork in opposite direction and terminate with a certain type of tappet or roller. In a possible realization, said two arms are aligned each other and they are both perpendicular to said cylindrical stem: said cylindrical stem and said two equal arms thus form a piece shaped as a "T".

2. A hollow cylindrical cam (thus an axial section of said hollow cylindrical cam has the shape of a circular crown); the driving profile of said hollow cylindrical cam is facing the inside of the central cavity and it may have an optimized shape, not necessarily sinusoidal, to prevent jamming and to best exploit the thrust of the piston, and said driving profile is twice identically replicated along the complete round angle.

3. An element here named "T-rod guidance", which is integral with the frame, is positioned at each end of the cylinder and it is thus located inside the central cavity of the cylindrical cam; said "T-rod guidance" element allows the sliding of said "T-rod" in the axial direction only, tying said its arms in order to prevent the rotation of the "T-rod" around its oscillating movement's axis.

BRIEF DESCRIPTION OF THE DRAWINGS

The Figures attached to this description represent an extract of a design of a potentially real implementation of a "CoNVEE" according to the teachings of the invention.

The above part of "FIG. 1" shows front view, i.e. the axial development, of a cylinder of said "CoNVEE" flanked by the motor shaft, while the part below of the same "FIG. 1" shows the plant view of the portion of the frame that supports them.

Figure 1:
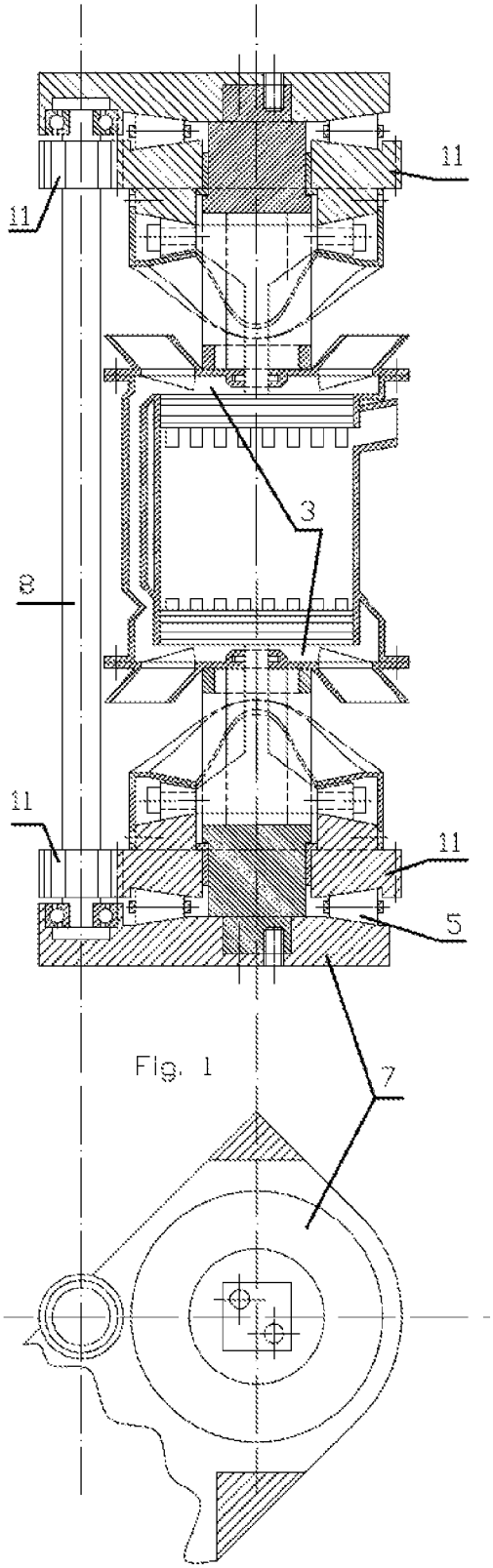
Figure 2:
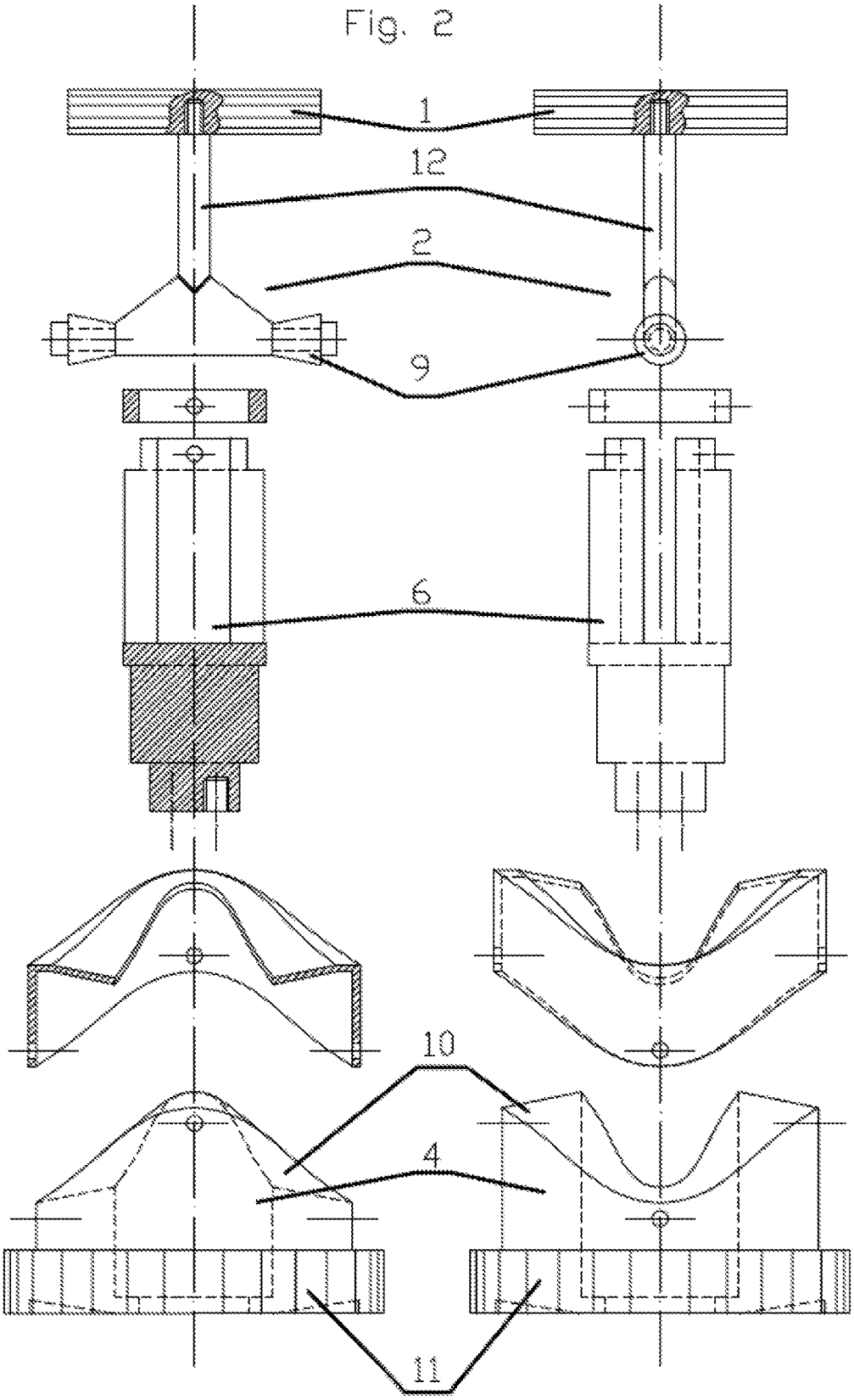
"FIG. 2" shows the two orthogonal section views (the front and the side, along the axis of the cylinder) of the fundamental parts of said cylinder.
Figure 3:
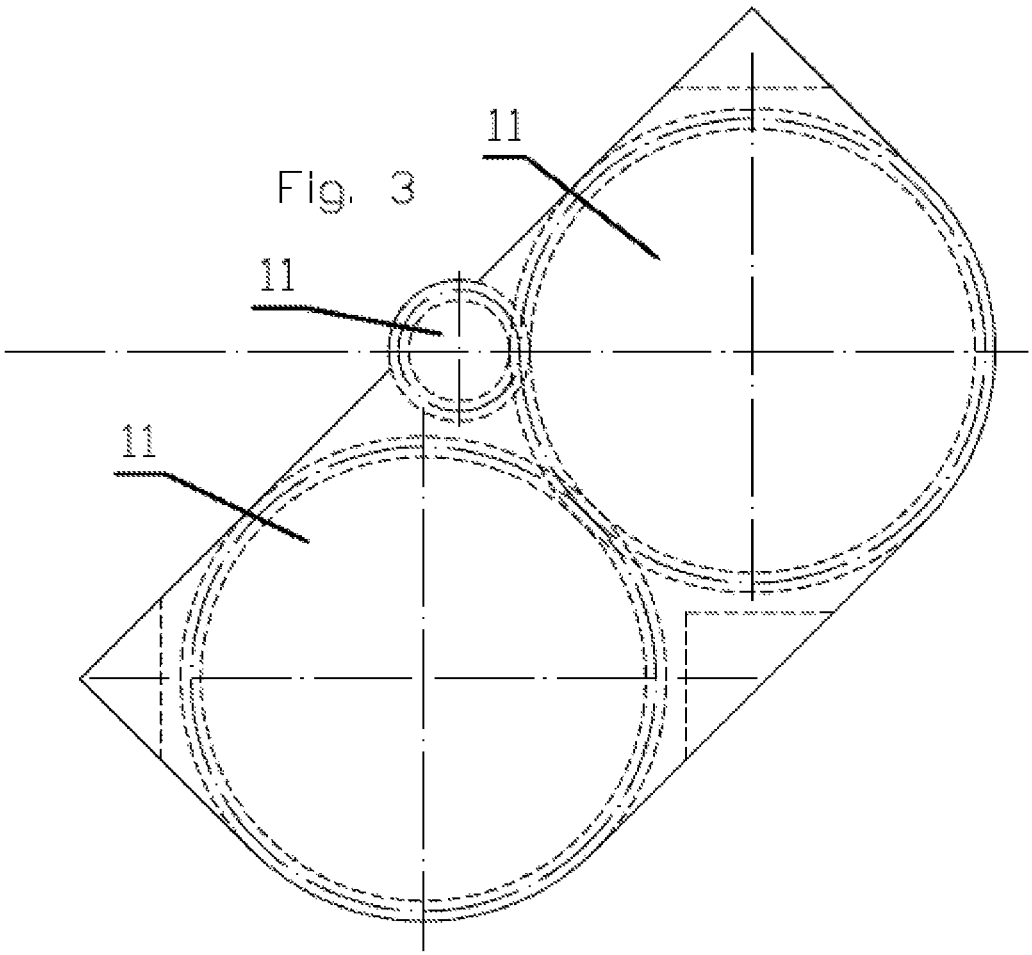
"FIG. 3" shows the view of the footprint of the two cylinders "CoNVEE".

Any construction detail outlined in the drawings and not explicitly described here is present with the purpose to provide an example of a possible assembly of the machine described; said details outlined in the drawings but not described above as essential characteristics of the invention are not binding on the implementation of a "CoNVEE" according to the present invention. It is therefore clear that further variants can be made by those experts in the field without departing from the scope of the invention as it is claimed in the following. List of items drawn:

1. Piston
2. "T-Rod"
3. Pre-compression Chamber
4. Cylindrical Cam
5. Axial Bearing
6. "T-Rod Guidance"
7. Frame
8. Motor Shaft/Synchronization Shaft
9. Tappets or rollers
10. Cam's driving profile
11. Gears
12. Stem

DETAILED DESCRIPTION OF THE PREFERRED EMBODIMENTS

An axial bearing 5 is applied on the frame 7 (a roller bearing or another type of bearing or, however, an element that constitutes an ideally nonstick interface). The cylindrical cam 4 can slide by rotating around its axis over said axial bearing. The two arms of said "T-rod" 2 are inserted into the "T-rod guidance" 6 and their ends are hooked on the driving profile of the cylindrical cam 4. The movement of the piston 1, according to the thermodynamic cycle that takes place in the cylinder, makes said arms of the "T-Rod" 2 to slide along said "T-rod guidance" 6 with a purely axial reciprocating movement; the ends of said arms will act as a tappet 9 on the driving profile of the cylindrical cam 4 that will draw a movement of pure rotation around its axis. Due to the action of said "T-rod guidance" 6 on said "T-rod" 2, the torque that moves the cam neither causes any rotation of said T-rod arms nor of the piston 1.

This mechanism, just described above, is characterized by the fact that it allows the transformation of the purely axial movement of the piston 1 into rotational movement of the cylindrical cam 4 around the same axis of oscillation of the piston 1. This mechanism has very few moving parts: just the "T-Rod" 2 rigidly attached to the piston 1 and the cylindrical cam 4 coupled through an axial bearing 5 to the frame 7 of the engine.

Differently from the classic rod-crank systems which are today widely used, the mechanism described in this invention does not raise any slap on the piston 1, whose skirt can therefore be significantly reduced, for example, the height of the piston 1 may be smaller than the radius of the piston 1 itself, thus obtaining great advantages due to the reduction in size which may be achieved.

The fact that the stem 12 of said "T-rod" 2 has a cylindrical section and its motion is purely axial, makes easier to achieve a pre-compression chamber 3 in which a wall closes the cylinder on the back of the piston 1 (and it is therefore crossed by said stem 12 of said "T-rod" 2); the engine may thus exploit the second effect (otherwise called back stroke) of the piston 1 to push the fresh input charge in the cylinder (it may arrive there via some non-return valves, strips or the like): this is also the best implementation for the scavenging of the cylinder in two-stroke cycle engines.

For this reason said "CoNVEE" uses a particular two-stroke cycle, with unidirectional scavenging of the combustion chamber: this type of scavenging is the most effective, but it requires two opposing pistons 1 in the cylinder (not wanting to use poppet valves) and, until today, it was mostly implemented using two crankshafts at the ends of the cylinder.

Thanks to the mechanism described in this invention, said "CoNVEE" neither need an external blower for scavenging of the combustion chamber (saving the associated encumbrance) nor the couple of shafts at the ends of the cylinder: two pistons 1, each with its related mechanisms according with this invention, are at the ends of the cylinder, and a single straight shaft, more thin of a crankshaft because stressed only to torsion, is placed nearby parallel to the cylinder axis; said shaft also acts as a synchronization shaft 8 (via gear trains 11 or the like) for the movement of the cylindrical cams 4.

The opposition of the two mechanisms according to the invention, operating in synchrony at the ends of the cylinder, balances the internal oscillating inertia: nevertheless the rotating inertia of cylindrical cams 4 (also gyroscopic effects in the case of movements of the entire engine) remains unbalanced and pulsating due to the thrust deriving from combustion. These last inconveniences may be managed in said "CoNVEE" by placing, side by side, two parallel and equal cylinders, each cylinder having two cylindrical cams 4 rotating in the opposite direction; the two mechanisms of the two cylinders may be directly meshed or synchronized each other through gear trains 11 or the like. In one possible different implementation two cylinders may have their thermodynamic cycle phase shifted by half a period so as to increase the continuity of motion, limiting the need for flywheel in addition to that already constituted by the cylindrical cams 4.

Given the same dimensions, it is therefore evident that said "CoNVEE", according to the teachings of the present invention, has a greater power density than any internal combustion engine up to now used in any kind of the prior art applications. Said "CoNVEE" also presents a greater simplicity of construction since it requires a lower number of moving parts, whose motion is moreover intrinsically balanced.

The invention claimed is:

1. An internal combustion two-strokes engine comprising at least one cylinder with two pistons inside, facing each other, having an axial reciprocating motion, each piston further comprising a T-rod, and wherein said cylinder comprises a combustion chamber which provides a unidirectional scavenging of exhaust gases;

wherein each of said two "T-rods" comprises a stem of cylindrical section parallel to the direction of motion of said two pistons and two arms;

wherein each of said stem is fixed, on one end, to the piston's back and, on the other end, it is fixed to said two arms that fork in opposite directions and said two arms are terminated with tappets or rollers;

wherein the stem of each T-rod moves along the cylinder axis without any rotation and said stem slides across a hole obtained in a wall that closes the end of said cylinder to form a pre-compression chamber in which said wall closes the cylinder on the back of the piston, wherein a backstroke of the piston pushes a fresh inlet charge into the cylinder between the two pistons;

wherein said internal combustion two-strokes engine, at each end of each cylinder comprises a "T-rod guidance" element attached to a frame of the engine, and said "T-rod guidance" binds said arms of the "T-rod", so that said "T-rod" and said relative fixed piston can slide along the axial direction of the cylinder, without a rotational movement;

wherein said engine comprises also a hollow cylindrical cam associated with each piston by means of said arms of said "T-rods" which act on the driving profiles of said two cylindrical cams; and wherein said cylindrical cam is coupled through an axial bearing to the frame of the engine;

and a straight motor shaft is coupled via gear trains, or other similar mechanisms to said two hollow cylindrical cams for the transfer of the motion, and its axis is parallel to the axis of said cylinder; said motor shaft is synchronizing the movement of the two pistons inside the cylinder.

2. The internal combustion two-strokes engine according to claim 1 wherein said each two hollow cylindrical cams associated to each cylinder contain said "T-rod" guidance element inside their cavity, and wherein said axis of said cylinder coincides with the axis of rotation of said two hollow cylindrical cams; and wherein said two hollow cylindrical cams are associated with the two pistons contained in said cylinder by means of said arms of said "T-rods" which act on a driving profiles of said two cylindrical cams via tappets or rollers; and wherein said two hollow cylindrical cams are bound to the frame so that they can only rotate around their axis.

3. The internal combustion two-strokes engine according to claim 2 wherein said driving profile of said hollow cylindrical cams have a shape repeated twice around the whole circumference of each hollow cylindrical cam.

4. The internal combustion two-strokes engine according to claim 2 wherein said hollow cylindrical cams which bear the motion to the shaft have smaller cross section's inner diameter compared to the cylinder's cross section diameter.

5. The internal combustion two-strokes engine according to claim 1 wherein said piston has a skirt having a length sufficiently short as to keep the piston's height shorter than the piston's radius because said engine does not cause any slap on said pistons.

6. The internal combustion two-strokes engine according to claim 1 wherein said straight motor shaft is coupled to at least two cylinders, placed parallel side by side, each cylinder having two cylindrical cams rotating in an opposite direction; wherein two mechanisms of said two cylinders are directly connected and synchronized through said gear trains.

7. The internal combustion two-strokes engine according to claim 1 wherein said straight motor shaft, which receives its motion from said cylindrical cams, serves also as a synchronization shaft between the two cylindrical cams associated to each cylinder of said internal combustion two-strokes engine, wherein said synchronization shaft is parallel to the cylinder's axis; and wherein said straight motor shaft assures a lack of engine vibrations.

8. The internal combustion two-strokes engine according to claim 1 wherein each pair of said hollow cylindrical cams, associated to one cylinder, shares its motion with another pair of cylindrical cams associated to another cylinder, and said two pairs of cylindrical cams are directly meshed or synchronized each other through gear trains, by way of the straight motor shaft, or other similar mechanisms for the transfer of the motion.

9. The internal combustion two-strokes engine according to claim 1 comprising at least two cylinders, each cylinder with two pistons inside, said cylinders having their thermodynamic cycle phases shifted by half a period so as to increase continuity of motion, eliminating a need for a flywheel.

* * * * *